US006642889B1

(12) United States Patent
McGrath

(10) Patent No.: US 6,642,889 B1
(45) Date of Patent: Nov. 4, 2003

(54) ASYMMETRIC-ELEMENT REFLECT ARRAY ANTENNA

(75) Inventor: Daniel T. McGrath, McKinney, TX (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 10/138,606

(22) Filed: May 3, 2002

(51) Int. Cl.[7] ..... H01Q 1/38

(52) U.S. Cl. ..... 343/700 MS; 343/876; 343/755

(58) Field of Search ..... 343/700 MS, 767, 343/770, 853, 876, 745, 755, 786, 781 CA, 781 P, 781 R

(56) References Cited

U.S. PATENT DOCUMENTS

| | | | | | |
|---|---|---|---|---|---|
| 4,053,895 | A | | 10/1977 | Malagisi | 343/700 MS |
| 4,509,209 | A | * | 4/1985 | Itoh et al. | 455/327 |
| 4,684,952 | A | | 8/1987 | Munson et al. | 343/700 MS |
| 4,777,490 | A | | 10/1988 | Sharma et al. | 343/754 |
| 5,122,809 | A | * | 6/1992 | Haruyama et al. | 343/700 MS |
| 5,148,182 | A | | 9/1992 | Gautier et al. | 343/754 |
| 5,227,807 | A | | 7/1993 | Bohlman et al. | 343/895 |
| 5,309,163 | A | | 5/1994 | Ngan et al. | 343/700 MS |
| 5,394,159 | A | * | 2/1995 | Schneider et al. | 343/700 MS |
| 5,410,323 | A | * | 4/1995 | Kuroda | 343/700 MS |
| 5,410,728 | A | | 4/1995 | Bertiger et al. | 455/13.1 |
| 5,511,238 | A | | 4/1996 | Bayraktaroglu | 455/81 |
| 5,777,581 | A | | 7/1998 | Lilly et al. | 343/700 MS |
| 5,835,062 | A | | 11/1998 | Heckaman et al. | 343/700 MS |
| 5,936,595 | A | | 8/1999 | Wang | 343/895 |
| 5,966,096 | A | * | 10/1999 | Brachat | 343/700 MS |
| 6,020,853 | A | | 2/2000 | Richards et al. | 343/700 MS |
| 6,061,025 | A | | 5/2000 | Jackson et al. | 343/700 MS |
| 6,081,234 | A | | 6/2000 | Huang et al. | 343/700 MS |
| 6,151,496 | A | | 11/2000 | Richards et al. | 455/428 |
| 6,195,047 | B1 | | 2/2001 | Richards | 343/700 MS |
| 6,351,240 | B1 | * | 2/2002 | Karimullah et al. | 343/700 MS |
| 6,384,787 | B1 | * | 5/2002 | Kim et al. | 343/700 MS |
| 6,441,787 | B1 | | 8/2002 | Richards et al. | 343/700 MS |

FOREIGN PATENT DOCUMENTS

| | | | |
|---|---|---|---|
| EP | 0 296 838 | 12/1988 | H03B/9/14 |
| EP | 0 682 382 | 11/1995 | H01Q/9/04 |
| JP | 01274505 | 11/1989 | H01Q/13/08 |

OTHER PUBLICATIONS

Derneryd, Anders G., "*Analysis of the Microstrip Disk Antenna Element*", IEEE Transactions on Antennas and Propagation, vol. AP–27, No. 5, , 0018–926X/79/0900–0660, Sep. 1979.

Colin, Jean–Marie, "*Phased Array Radars in France: Present and Future*", IEEE, pp. 458–462, Jun. 1996.

Huang, John, "*Bandwidth Study of Microstrip Reflectarray and a Novel Phased Reflectarray Concept*", IEEE, pp. 582–585, Jul. 1995.

Huang, John, and Pogorzelski, Ronald J., "*A Ka–Band Microstrip Reflectarray with Elements Having Variable Rotation Angles*", IEEE Transactions on Antennas and Propagation, vol. 46, No. 5, May 1998, pp. 650–656, May 1998.

Oberhard, M.L. and Lo, Y.T., "*Simple Method of Experimentally Investigating Scanning Microstrip Antenna Arrays without Phase–Shifting Devices*", Electronic Letters, vol. 25, No. 16, pp. 1042–1043, Aug. 3, 1989.

Swenson, G.W., Jr., "*The University of Illinois Radio Telescope*", IRE Transactions on Antennas and Propagation, pp. 9–16, Jan. 1961.

* cited by examiner

*Primary Examiner*—Tan Ho

(74) *Attorney, Agent, or Firm*—Baker Botts L.L.P.

(57) ABSTRACT

A reflect array antenna comprises a non-electrically conductive substrate with an array of antenna elements supported on the substrate. Each antenna element comprises a plurality of patch radiating elements arranged in rows and columns. Each patch radiating element comprises a plurality of notches formed in the element, the notches being angularly displaced around the circumference of the element. A plurality of stub short transmission lines are individually positioned in each of the plurality of notches and a plurality of switches individually couple one end of a notch to one of the plurality of stub short transmission lines.

27 Claims, 5 Drawing Sheets

ASYMMETRIC-ELEMENT REFLECT ARRAY ANTENNA

RELATED PATENTS

This application is related to U.S. application Ser. No. 09/181,591, entitled Microstrip Phase Shifting Reflect Array Antenna, filed on Oct. 28, 1988, now U.S. Pat. No. 6,020,853. This application is also related to U.S. application Ser. No. 09/181,457, entitled Integrated Microelectromechanical Phase Shifting Reflect Array Antenna, filed on Oct. 28, 1988, now U.S. Pat. No, 6,195,047.

TECHNICAL FIELD OF THE INVENTION

This invention relates to reflect array antennas, and more particularly to a microstrip asymmetric-element phase shifting reflect array antenna.

BACKGROUND OF THE INVENTION

Many radar, electronic warfare and communication systems require a circularly polarized antenna with high gain and low axial ratio. Conventional mechanically scanned reflector antennas are available to meet these specifications. However, such antennas are bulky, difficult to install, and subject to performance degradation in winds. Planar phased arrays may also be employed in these applications. However, these antennas are costly because of the large number of expensive GaAs Monolithic microwave integrated circuit components, including an amplifier and phase shifter at each array element as well as a feed manifold and complex packaging. Furthermore, attempts to feed each microstrip element from a common input/output port becomes impractical due to the high losses incurred in the long microstrip transmission lines, especially in large arrays.

Conventional microstrip reflect array antennas use an array of microstrip antennas as collecting and radiating elements. Conventional reflect array antennas use either delay lines of fixed lengths connected to each microstrip element to produce a fixed beam or use an electronic phase shifter connected to each microstrip element to produce an electronically scanning beam. These conventional reflect array antennas are not desirable because the fixed beam reflect arrays suffer from gain ripple over the reflect array operating bandwidth, and the electronically scanned reflect array suffer from high cost and high phase shifter losses.

It is also known that a desired phase variation across a circularly polarized array is achievable by mechanically rotating the individual circularly polarized array elements. Miniature mechanical motors or rotators have been used to rotate each array element to the appropriate angular orientation. However, the use of such mechanical rotation devices and the controllers introduce mechanical reliability problems. Further, the manufacturing process of such antennas are labor intensive and costly.

In U.S. Pat. No. 4,053,895 entitled "Electronically Scanned Microstrip Antenna Array" issued to Malagisi on Oct. 11, 1977, antennas having at least two pairs of diametrically opposed short circuit shunt switches placed at different angles around the periphery of a microstrip disk is described. The shunt switches connect the periphery of the microstrip disk to a ground reference plane. Phase shifting of the circularly polarized reflect array elements is achieved by varying the angular position of the short-circuit plane created by diametrically opposed pairs of diode shunt switches. This antenna is of limited utility because of the complicated labor intensive manufacturing process required to connect the shunt switches and associated bias network between the microstrip disk and ground, as well as the cost of the circuitry required to control the diodes.

SUMMARY OF THE INVENTION

In accordance with the present invention, there is provided a reflect array antenna providing electronic beam scanning at low cost. The reflect array antenna of the present invention enables an increase in the number of phase states for the reflect array elements, while reducing the number of switches required to provide electronic beam scanning. The reflect array antenna of the present invention provides increased performance for a given frequency, that is, a greater number of discreet phase states for a given number of switches. Alternatively, the described reflect array antenna provides improved performance (number of phase states) at a higher frequency due to the ability to utilize fewer switches and therefore provide phase shift integration. This enables the claimed reflect array antenna to be used as an electronically steered array (ESA) at millimeter wave frequencies for applications requiring low cost, for example, millimeter wave communication apertures, and millimeter wave missile seekers.

In accordance with the present invention, there is provided a reflect array antenna comprising a non-electrically conductive substrate with the antenna array supported on the substrate. Each array of the antenna comprises patch antenna elements having a plurality of notches formed in the antenna element, the notches are angularly displaced around the circumference of the element. A plurality of stub short transmission lines are individually positioned in each of the plurality of notches. A plurality of switches are individually coupled to an end of one notch and to one of the plurality of stub short transmission lines.

Further in accordance with the present invention, there is provided an antenna element for a reflect array antenna comprising as an element thereof a non-electrically conductive substrate. Supported on the substrate is a patch antenna element having a plurality of notches formed in the element, the notches are angularly displaced around a circumference of the element. A plurality of stub short transmission lines are individually positioned in each of the plurality of notches and a plurality of switches individually couple an end of one notch to one of the plurality of stub short transmission lines.

Further in accordance with the present invention, there is provided a circularly polarized reflect array antenna comprising a support base and plurality of antenna. subarrays mounted to the support base. Each antenna subarray comprises a non-electrically conductive substrate with a patch antenna supported on the substrate. Each patch antenna of the array comprises a patch antenna element having a plurality of notches formed in the antenna element, the notches are angularly displaced around the circumference of the element. A plurality of stub short transmission lines are individually positioned in each of the plurality of notches, and a plurality of switches are individually coupled to an end of one notch and to one of the plurality of stub short transmission lines. In addition, the circular polarized reflect array antenna comprises a feed horn coupled to the support base for transmitting or receiving radio frequency energy to a subreflector, the subreflector focusing the radio frequency energy received by the plurality of antenna subarrays to the feed horn.

A technical advantage of the present invention is a simplified method for building an electronic scanning reflect array antenna. The advantages of the present invention are achieved by an antenna containing a lattice of circular patch antennas with perimeter stubs connected to the patches by switches. A further advantage of the present invention is a reduction of the number of stub short transmission lines and switches required to control beam steering.

BRIEF DESCRIPTION OF THE DRAWINGS

For a more complete understanding of the present invention and the advantages thereof, reference is now made to the accompanying drawings, wherein.

DETAILED DESCRIPTION OF THE INVENTION

Figure 1:
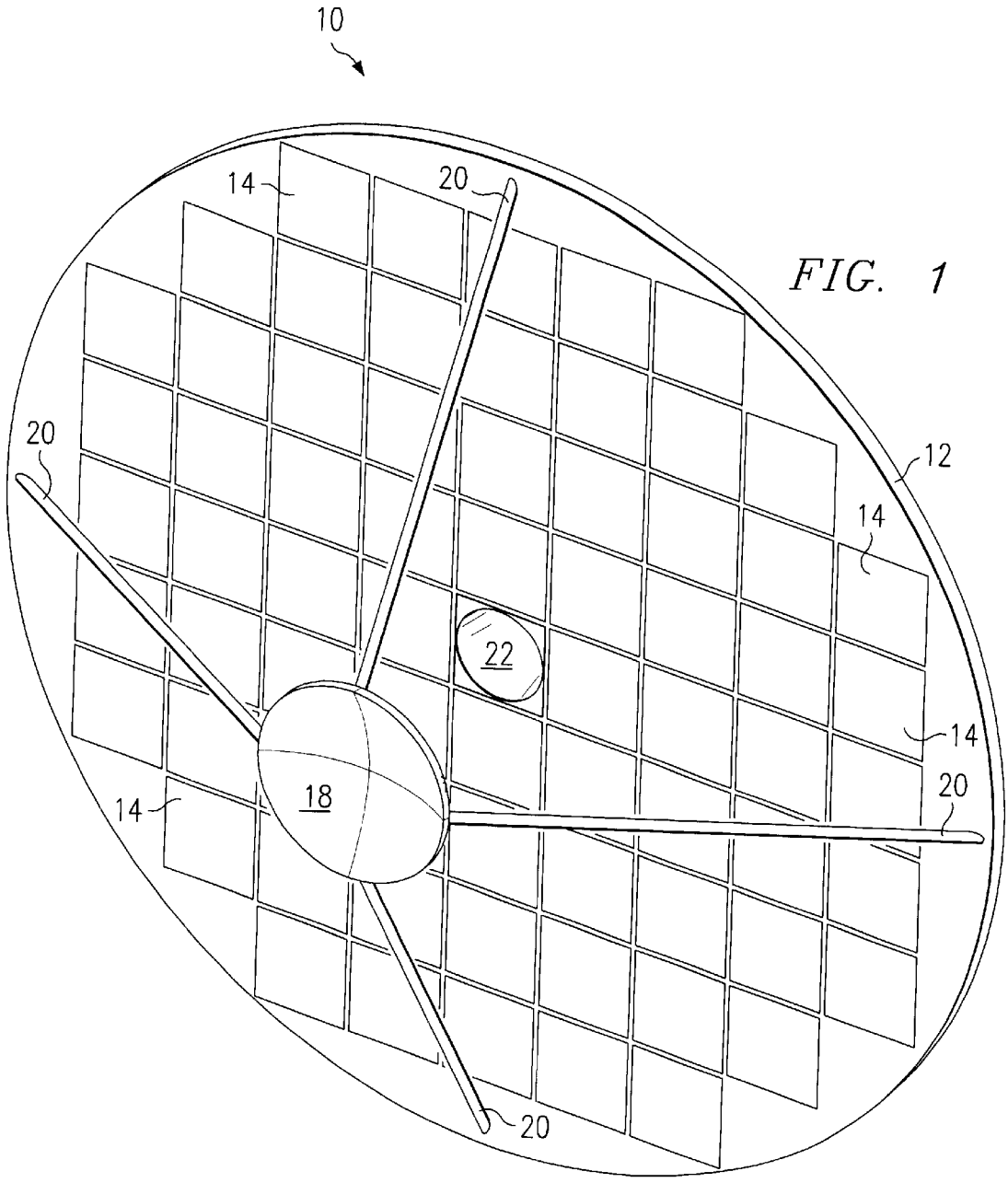
FIG. 1 is a perspective view of a Cassegrain configured reflect array antenna utilizing monolithic fabrication.

A preferred embodiment of the present invention is illustrated in FIGS. 1 through 6 where like reference numerals are used to refer to like and corresponding parts of the various drawings.

Figure 2:
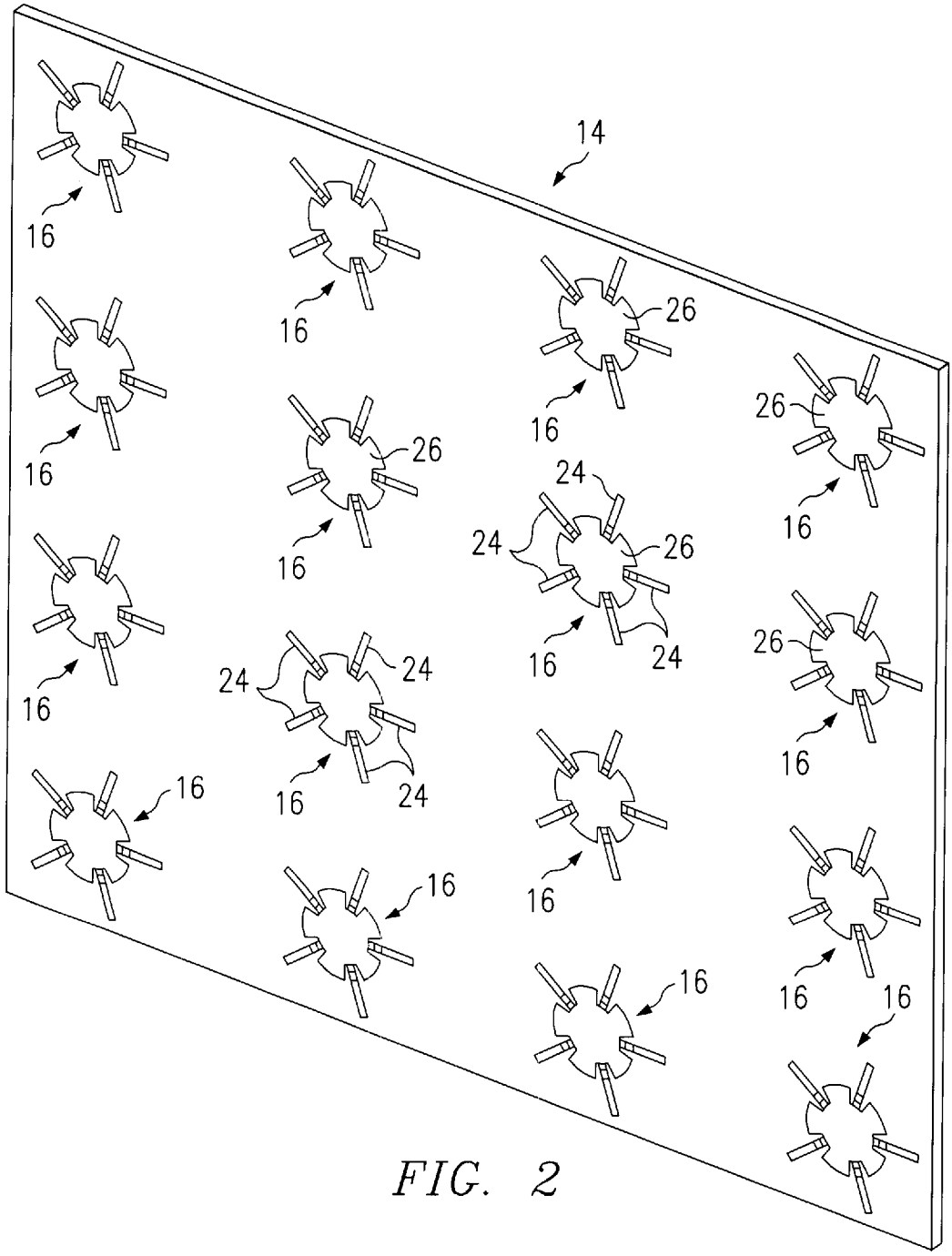
FIG. 2 is a perspective view of one of the subarrays of the reflect array antenna of FIG. 1.

Referring to FIG. 1, there is illustrated a microstrip phase shifting reflect array antenna 10 in accordance with the present invention. As illustrated, the antenna 10 includes a substantially flat circular disk 12 supporting a plurality of subarrays 14 where each subarray 14 supports a plurality of array elements 16 disposed in a regular and repeating pattern as illustrated in FIG. 2. The array elements 16 may be etched on the top side of an insulating dielectric sheet, which may be supported and strengthened by a thicker flat panel. For high frequencies, the array elements may be constructed as thin or thick film metallization on a semiconductor substrate.

As illustrated in FIG. 1, the subarrays 14 supporting antenna elements 16 are arranged in rows and columns on the disk 12. A subreflector 18 is located above the disk 12, either centered (as shown) or offset over the plurality of subarrays 14. The subreflector 18 is supported from the disk 12 by supports 20. Energy captured by the subreflector 18 is focused onto a feed horn 22 connected to processing circuitry for the radio frequency energy captured by the antenna elements 16 of the subarrays 14.

Although the antenna 10 is shown on a substantially flat substrate 12, it will be understood that the invention contemplates substrates that may be curved or formed to some physical contour to meet installation requirements or space limitations. The variation in the substrate plane geometry and the spherical wavefront from the feed and steering of the beam may be corrected by modifying the phase shift state of array elements 16. Further, the subarrays 14 may be fabricated separately and then assembled on site to increase the portability of the antenna and facilitate its installation and deployment.

Figure 3:
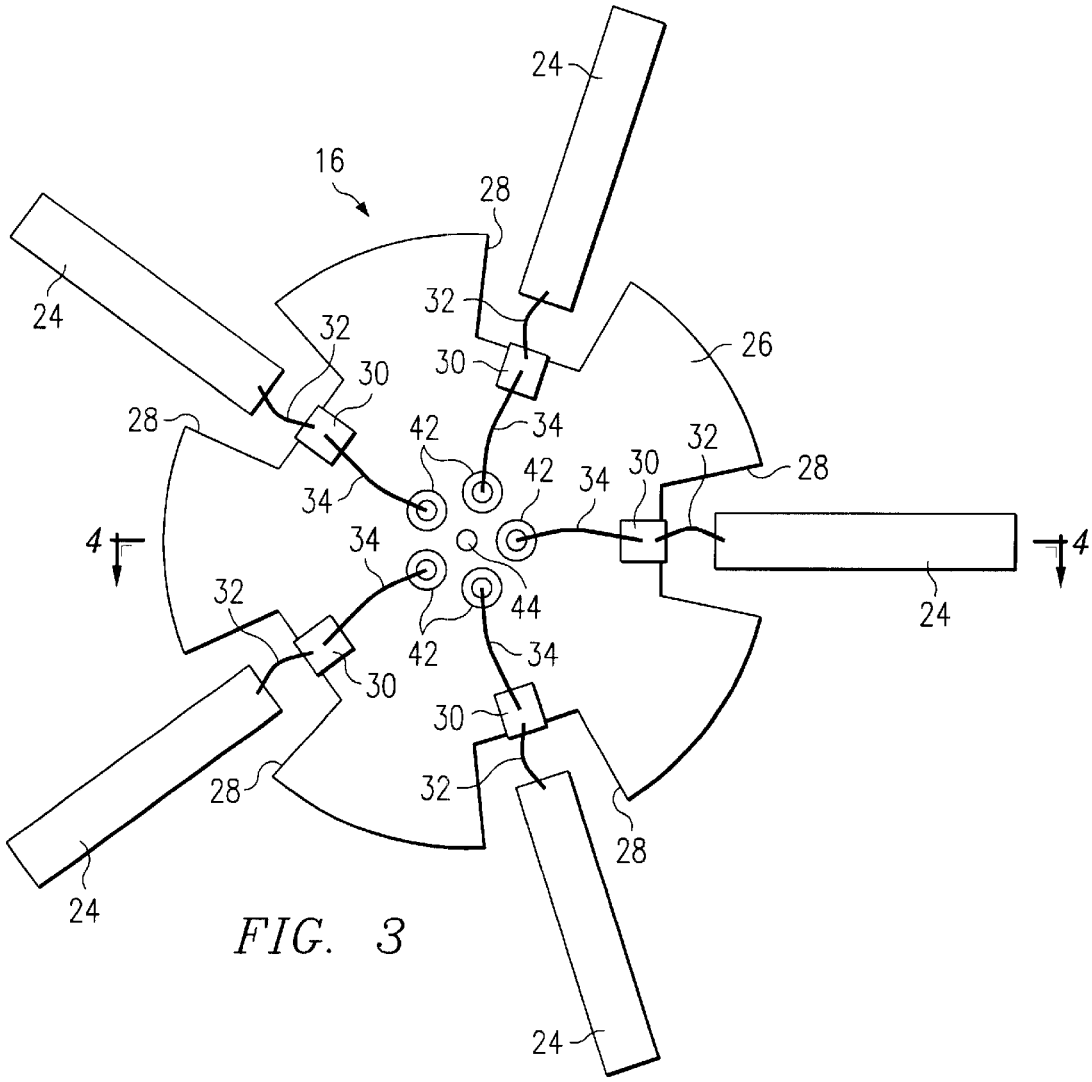
FIG. 3 is a plan view of a reflect array antenna element with asymmetric inset stubs in accordance with one embodiment of the invention.

Referring to FIGS. 2 and 3, the reflect array antenna of FIG. 1 utilizes antenna elements 16 comprising switched microstrip stubs 24 arranged around the perimeter of circular microstrip patch radiating elements 26. Incident circularly polarized energy is captured by the patch radiating elements 26 and reflected with a phase shift that depends on which stub is electrically short circuited to the patch radiating element. Each circular microstrip patch radiating element 26 has an odd number of microstrip stubs 24 arranged at uniform angular increments around the perimeter of the antenna element. Each of the microstrip stubs 24 are inset into notches 28 extending from the perimeter of the antenna element 26 for impedance matching as will be explained. Electronic switches 30 such as PIN diodes FETS or MEMS are interconnected to a respective microstrip stub 24 by means of bond wires 32. The requirement of the electronic switches 30 is that when a switch is in the "off" or "on" state, it is a good RF open or short circuit, respectively.

As illustrated in FIG. 3, PIN diodes are utilized as the electronic switches 30 and function as the reflect array control elements. The chip diodes shown in FIG. 3 are mounted to the surface of the radiating element 26 typically by means of a conducting adhesive. The top surface of each diode is connected to one of the microstrip stubs 24 by means of the bond wires 32 and to a DC bias connection (not shown in FIG. 3) using bond wires 34. When a positive voltage is applied to one of the DC bias connections, the respective electronic switch 30 is forward biased, thereby creating an RF short circuit by operation of the electronic switch thereby allowing a current to flow between one of the microstrip stubs 24 and the respective patch radiating element 26. Thus, the electronic switches 30 control the phase of the reflective energy, for example, with five stubs as illustrated in FIG. 3, relative phase shifts of 0 degrees, 72 degrees, 144 degrees, 216 degrees, and 280 degrees, may be achieved. An alternative fabrication method uses a semiconductor substrate 14 with all of the PIN diodes constructed at once using established semiconductor manufacturing process. This method would make it possible to use the reflect array at millimeter wave frequencies, where the small dimensions of the patches and stubs would make individually-placed and wire-bonded diodes impractical.

A feature of the present invention is the use of asymmetric inset microstrip stubs 24. As previously mentioned, the stubs are inset into the perimeter of the radiating element 26 for impedance matching since the stubs 24 serve as short transmission line sections. For best operation, the microstrip stubs 24 are impedance matched to the patch radiating element 26 at the connection points of the electronic switches 30. Typically, the input impedance of a circular patch radiating element 26 is 300 to 500 Ohms at the perimeter, while the microstrip stubs typically have a 100 Ohm characteristic impedance. The insets place the attachment points inside the patch perimeter, where its input impedance is nearer to 100 Ohms.

Figure 4:
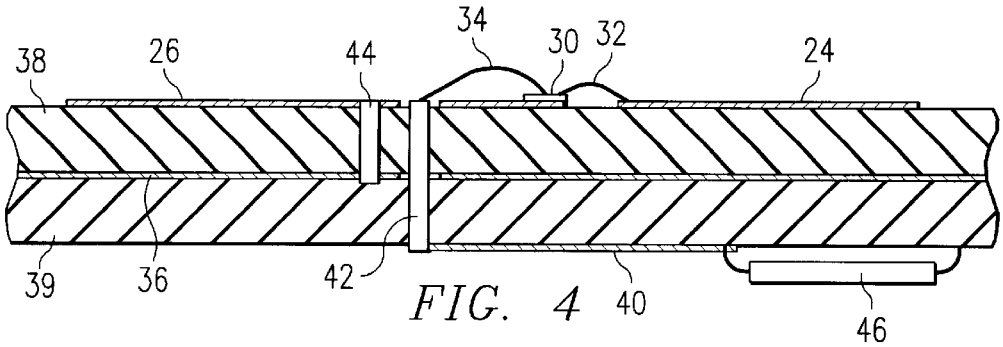
FIG. 4 is a cross-sectional view of an embodiment of an array element constructed according to the teachings of the present invention.

Referring to FIGS. 3 and 4, an individual antenna element 16 comprises a metallic disk member 26, a metallic ground plane member 36, and dielectric medium 38 and 39 functioning as insulating layers (the RF substrate 38 and DC substrate 39). Also comprising each of the radiating elements 26 is a DC bias connection metallized conductor 40 on the bottom side of the insulating layer 39. As illustrated in FIG. 4, the two dielectric medium substrates 38 and 39 are isolated from each other by means of the ground plane 36 which comprises metallization on either the bottom of the RF substrate 38 or the top of the DC substrate 39. A DC bias connection from the conductor 40 to the bond wires 34 are by means of vias 42 passing through small holes in the ground plane 36. Also metallized on the top surface of the RF substrate 38 are the microstrip stubs 24.

The antenna elements 16 either singly or in an array are fabricated by etching a printed circuit board or semiconductor substrate using conventional microcircuit techniques. The center of each circular radiating element 26 is short-circuited to the ground plane 36 by an RF ground via 44. As illustrated in FIG. 4, the electronic switch 30 is bonded to the radiating element 26 and connected to the microstrip stub 24 by means of a bond wire 32 and to the via 42 by means of the bond wire 34.

Also as illustrated in FIG. 4 is a DC control circuit 46 on the DC substrate 39 and connected to the DC bias connector 40. The function of the DC control circuit 46 is to demultiplex beam steering controls that are distributed to the reflect array antenna elements 16 by a bus (parallel conductors) as will be described. The second function of the control circuit 46 is to generate an output to drive the electronic switch 30 thereby providing the current required to turn the electronic switches "off" or "on". Typically, the DC control circuit 46 is a conventional decoder and diode driver such as those extensively used in digital displays.

Figure 5:
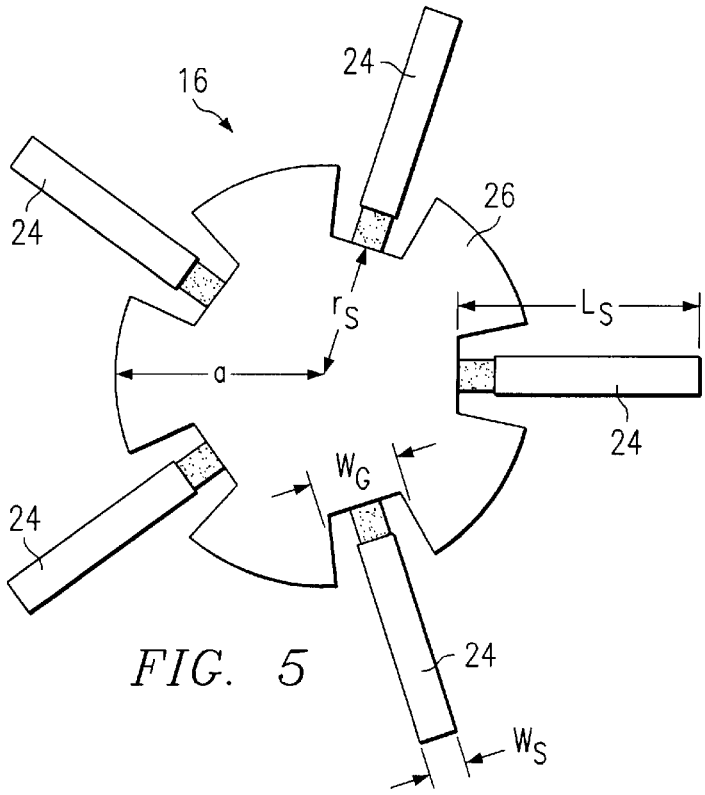
FIG. 5 is a schematic representation of an array element as part of the subarray of FIG. 2 for the reflect array antenna of FIG. 1.

Referring to FIG. 5, there are five dimensions that must be considered in the fabrication of a reflect array element 16. The five dimensions vary with four parameters of the reflect array element. The four parameters are the operating frequency (f) and associated wavelength ($\lambda$); the permittivity of the supporting dielectric substrate ($\epsilon_r$); and the thickness of the substrate (h).

The resonant frequency of a microstrip patch antenna element with radius "a", is approximately given by the following equation:

$$f = \frac{ck_{11}}{2\pi a_{eff}\sqrt{\varepsilon_r}} \tag{1}$$

where $a_{eff}$ is the effective radius, given by $$a_{eff} = a\left\{1 + \frac{2h}{\pi a \varepsilon_r}\left[\ln\left(\frac{\pi a}{2h}\right) + 1.7726\right]\right\}^{1/2} \tag{2}$$

and $k_{11}$=1.841 (the first zero of the derivative of the Bessel function $J_1$). The constant $k_{11}$ is selected in place of the more general $K_{mm}$ because the circular patch antenna element 16 is intended to function as a cavity resonator in the $TM_{11}$ mode. To ensure that other modes are not excited, a via 44 will be placed at the center of the patch, shorting it to the ground plane.

The stub width ($W_s$), FIG. 5, is selected to yield a characteristic impedance between 50 and 150 Ohms. This selection depends on the substrate material and the resulting sensitivity of impedance to the line width (some choices may result in excessively wide or narrow lines). The following approximate formula gives the characteristic impedance ($Z_0$) in terms of an effective relative permittivity $\epsilon_{eff}$:

$$Z_0 \approx \begin{cases} \dfrac{60}{\sqrt{\varepsilon_{eff}}}\ln\left(\dfrac{8h}{w} + \dfrac{w}{4h}\right) & \text{for } w/h \le 1 \\ \dfrac{120\pi}{\sqrt{\varepsilon_{eff}}}\left[\dfrac{w}{h} + 1.393 + .667\ \ln\left(\dfrac{w}{h} + 1.444\right)\right]^{-1} & \text{for } w/h \ge 1 \end{cases} \tag{3}$$

and the effective relative permittivity is $$\varepsilon_{eff} = \frac{\varepsilon_r + 1}{2} + \frac{\varepsilon_r - 1}{2}\left(1 + 12\frac{h}{w}\right)^{-1/2} \tag{4}$$

Next, the stub length ($L_s$)is chosen to be approximately one quarter wavelength, to provide a two-way path length of $\lambda/2$. However, the length must account for the fact that an open-ended microstrip line is electrically longer than its physical length due to field fringing at the open end. An approximate formula for the length extension due to fringing is:

$$\Delta L = .412h\left(\frac{\varepsilon_{eff} + .3}{\varepsilon_{eff} - .258}\right)\left(\frac{w/h + .264}{w/h + .8}\right) \tag{5}$$

The stub length also includes the length of the switch itself, as indicated by the shaded areas in FIG. 5.

The input impedance of a circular microstrip patch varies from zero at the center to 250 Ohms or more at the edge. The depth of the inset notch 28 ($a-r_s$) is chosen such that the input impedance of the radiating element 26 at the radius $r_s$ is equal to the characteristic impedance of the microstrip stub 24. For a characteristic impedance of 50 Ohms and 100 Ohms, $r_s$ will be approximately a/3 and a/2, respectively.

Last, the gap width ($w_g$) of the notch 28 is chosen to be wide enough so as not significantly change the characteristic impedance of the microstrip stub 24. For example, if the gap width ($w_g$) is only slightly wider than the microstrip stub, then the inset portion of the stub will essentially be a coplanar waveguide instead of a microstrip. The result would be a characteristic impedance of the inset portion that will be different from that of the portion of the microstrip stub outside the perimeter of the radiating element 26. A rule of thumb is that $w_g$ should be greater than or equal to the substrate thickness (h).

Figure 6:
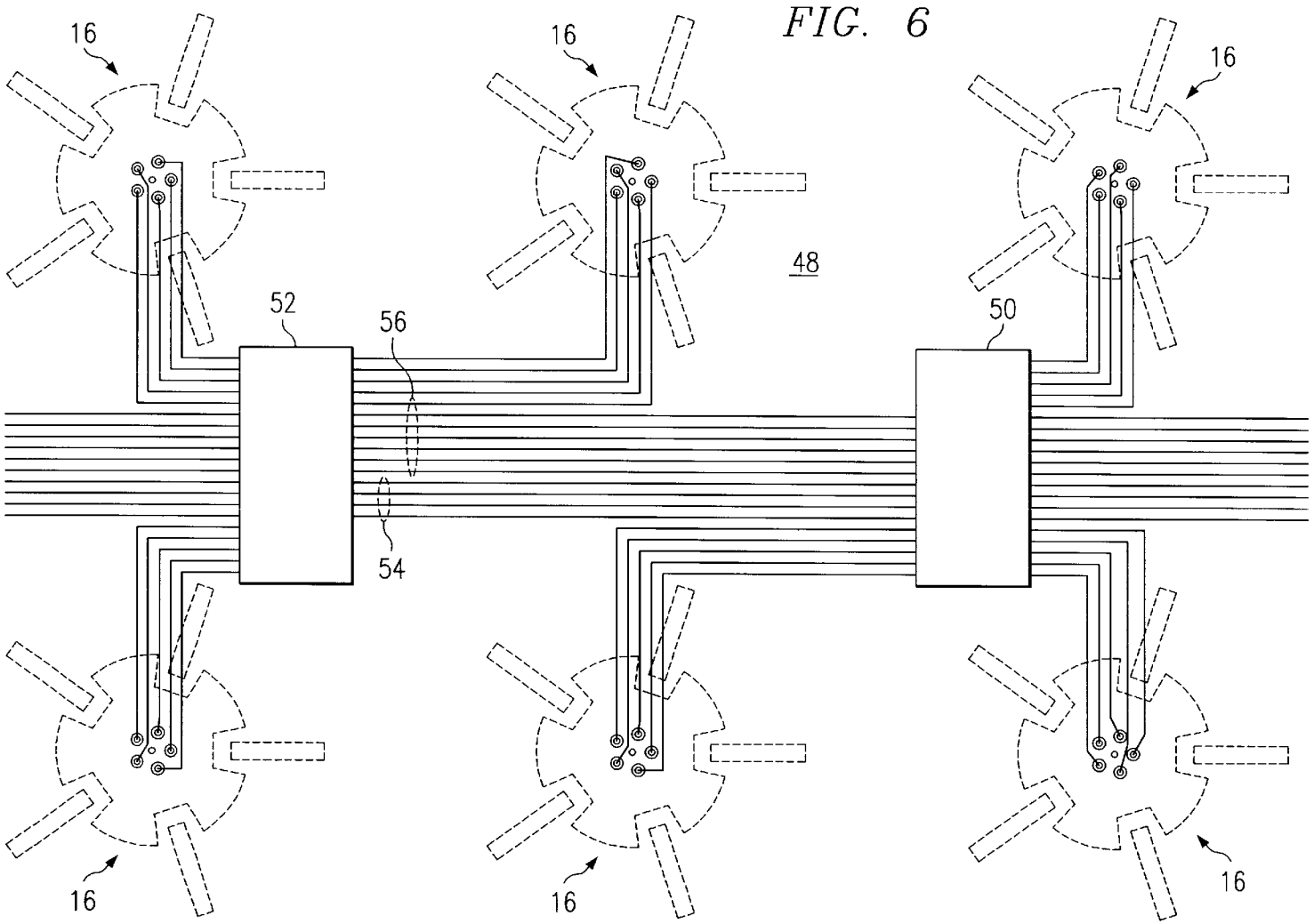
FIG. 6 is a schematic representation of the use of 16 segment decoder/driver integrated circuits for control of the diode switches for the patch antenna elements as illustrated in FIG. 5.

Referring to FIG. 6, reflect array antenna beam steering involves two considerations, the electronic switches 30, and the control of the switching elements. The switches 30 are controlled by the circuit of FIG. 6 that activates the individual switches in essentially the same operation as for memory or display bits. The address and data bus provides switching commands to multiple decoder/driver circuits mounted on a control circuit layer beneath the reflect array. FIG. 6 is an example of the use of 16-segment decoder/driver integrated circuits 50 and 52. The decoder/driver chip 50 is interconnected to three reflect array antenna elements 16. The decoder/driver chip 52 also interconnects to three reflect array antenna elements 16. The control circuit of FIG. 6 is repeated with additional decoder/driver chips sequentially connected by the address lines 56 and data lines 54 until all of the reflect array antenna elements 16 of the antenna 10 are connected to a decoder/driver chip. The address and data lines originate at the parallel output port of a computer.

In operation, varying the phase shift at each array antenna element 16 is achieved by operating the electronic switches 30 from the control circuit of FIG. 6. Only one of the electronic switches 30 for each antenna element 16 is "on", that is, connecting a microstrip stub 24 to ground at any instant of time. Phase shifting of the circularly polarized reflect array antenna elements 16 is achieved by varying the angular position of the short-circuited plane created by switching between different electronic switches 30. Operating in this manner, array antenna elements 16 collectively form a circularly polarized antenna.

Figure 7:
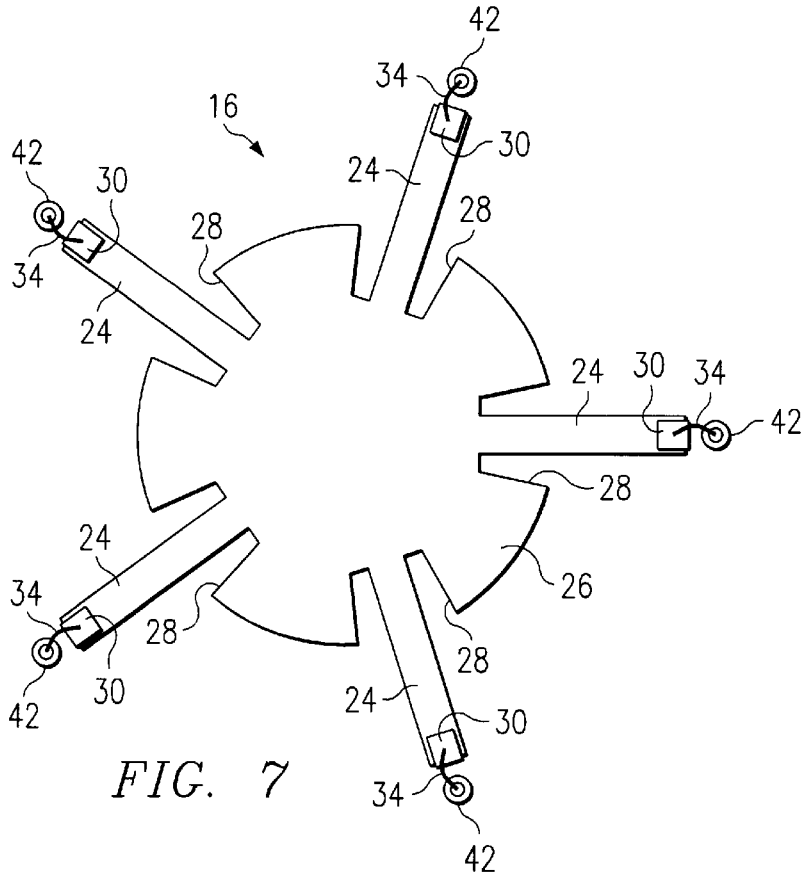
FIG. 7 is an alternate embodiment of an asymmetric antenna element for a reflect array antenna as illustrated in FIG. 1.

Referring to FIG. 7, there is shown another embodiment of an array antenna element for use with a reflect array antenna as illustrated in FIG. 1. As illustrated in FIG. 7, the bond wires 34 connected by means of the via 42 to the DC bias connector 40 are at the ends of the stubs 24. The bond wire 34 is also attached to an electronic switch 30 fabricated to the end of the microstrip stub 24. Each of the microstrip stubs 24 are permanently joined to the radiating element 26 at the base of the notch 28. Again, the radiating element 26 couples to the ground plane 36 (FIG. 4) by means of the via 44.

In operation of the embodiment of FIG. 7, the electronic switches 30 create either an open circuit or a short circuit boundary condition at the end of a microstrip stub 24, depending on whether the switch is in the "off" or "on" state, respectively. In accordance with this embodiment the electronic switches 30 and the DC control vias 42 are outside the perimeter of the radiating element 26, and therefore less likely to alter the RF performance of the antenna element.

Although several embodiments of the present invention and the advantages thereof have been described in detail, it should be understood that changes, substitutions, transformations, modifications, variations, and alterations may be made without departing from the teachings of the present invention, or the spirit and scope of the invention as set forth in the appended claims.

What is claimed is:

1. A patch antenna element, comprising:

a non-electrically conducting substrate;

a patch antenna element;

a plurality of notches formed in the antenna element an angularly displaced around the circumference of the patch antenna element;

a plurality of stub short transmission lines, each stub positioned in one of the plurality of notches; and a plurality of switches individually coupled to an end of one notch and to one of the plurality of stub short transmission lines.

2. The antenna element as in claim 1 wherein the plurality of notches and the plurality of stub short transmission line comprise a non-even number.

3. The antenna element as in claim 1 wherein the dimensions of each of the plurality of notches varies with the impedance of the patch antenna element and the impedance of the stub short transmission lines.

4. The antenna element as in claim 1 wherein the patch antenna element comprises a circular configuration having a diameter determined by the frequency of operation of the antenna element and the density of the substrate.

5. The antenna element of claim 4 wherein the configuration of each of the plurality of notches varies with the circumference impedance of the patch antenna element and the impedance of each of the plurality of stub short transmission lines.

6. The antenna element as in claim 5 wherein the configuration of each notch is selected to produce an impedance match between the impedance of the stub short transmission lines and the impedance of the patch antenna element.

7. The antenna element as in claim 1 wherein the plurality of switches are selected from the group comprising: diodes, field effect transistors (FETs) or EMs devices.

8. A reflect array antenna, comprising:

a non-electrically conductive substrate;

an antenna array supported on the substrate, each antenna of the array comprising:

a patch antenna element;

a plurality of notches formed in the patch antenna element and angularly displaced around a circumference of the patch antenna element;

a plurality of stub short transmission line, each stub positioned in one of the plurality of notches; and a plurality of switches individually coupled to an end of one notch and to one of the plurality of stub short transmission lines.

9. The reflect array antenna as in claim 8 wherein the plurality of notches and the plurality of stub short transmission line comprise a non-even number.

10. The reflect array antenna as in claim 8 wherein the dimensions of each of the plurality of notches varies with the impedance of the patch antenna element and the impedance of the stub short transmission lines.

11. The reflect array antenna as in claim 8 wherein the patch antenna element comprises a circular configuration having a diameter determined by the frequency of operation of the antenna element and the density of the substrate.

12. The reflect array antenna of claim 11 wherein the configuration of each of the plurality of notches varies with the impedance of the circumference of the patch and the impedance of each of the plurality of stub short transmission lines.

13. The reflect array antenna as in claim 11 wherein the configuration of each notch is selected to produce an impedance match between the impedance of the stub short transmission lines and the impedance of the patch antenna element.

14. The reflect array antenna as in claim 8 wherein the stub short transmission lines are uniformly spaced about the circumference of the patch antenna element.

15. The reflect array antenna as in claim 8 wherein each stub short transmission line comprises a length selected for impedance matching to the patch antenna element at the connection point in the respective notch.

16. A circularly polarized reflect array antenna, comprising:

a support substrate;

a plurality of subarrays supported on the support substrate, each subarray comprising a plurality of antenna elements, each antenna element comprising:

a patch antenna element;

a plurality of notches formed in the patch antenna element and angularly displaced around a circumference of the patch antenna element;

a plurality of stub short transmission lines, each stub positioned in one of the plurality of notches; and a plurality of switches individually coupled to an end of one notch and to one of the plurality of stub short transmission lines.

17. The circularly polarized reflect array antenna as in claim 16 wherein the plurality of notches and the plurality of stub short transmission line comprise a non-even number.

18. The circularly polarized reflect array antenna as in claim 16 wherein the dimensions of each of the plurality of notches varies with the impedance of the patch antenna element and the impedance of the stub short transmission lines.

19. The circularly polarized reflect array antenna as in claim 16 wherein the patch antenna element comprises a circular configuration having a diameter determined by the frequency of operation of the antenna element and the density of the substrate.

20. The circularly polarized reflect array antenna of claim 19 wherein the configuration of each of the plurality of notches varies with the impedance of the circumference of the patch antenna element and the impedance of each of the plurality of stub short transmission lines.

21. The circularly polarized reflect array antenna as in claim 20 wherein the configuration of each notch is selected to produce an impedance match between the impedance of the stub short transmission lines and the impedance of the patch antenna element.

22. The circularly polarized reflect array antenna as in claim 16 wherein the stub short transmission lines are uniformly spaced about the circumference of the patch antenna element.

23. The circularly polarized reflect array antenna as in claim 16 wherein each stub short transmission line comprises a length selected for impedance matching to the patch antenna element at the connection point in the respective notch.

24. The circularly polarized reflect array antenna as in claim 16 further comprising:

a scanning array controller coupled to each of the plurality of switches to activate each switch to scan the reflect array antenna in a controlled pattern.

25. A circularly polarized reflect array antenna, comprising:

a plurality of subarrays supported on a support base, each subarray comprising a plurality of antenna elements, each antenna element comprising:

a patch antenna element;

a plurality of notches formed in the patch antenna element and angularly displaced around a circumference of the patch antenna element;

a plurality of stub short transmission lines each stub positioned in one of the plurality of notches;

a plurality of switches individually coupled to an end of one notch and to one of the plurality of stub short transmission lines;

a feed horn coupled to the support base for transmitting or receiving radio frequency energy; and a subreflector supported on the support base for focusing radio frequency energy from the feed horn to the plurality of subarrays.

26. The circularly polarized reflect array antenna as in claim 25, further comprising:

a scanning array controller coupled to each of the plurality of switches to activate each switch to scan the reflect array antenna in a controlled pattern.

27. The circularly polarized reflect array antenna as in claim 26 wherein the support base comprises a semiconductor substrate with a ground plane; and further comprising a plated via for shorting the patch antenna elements to the ground plane.

* * * * *

UNITED STATES PATENT AND TRADEMARK OFFICE

CERTIFICATE OF CORRECTION

PATENT NO. : 6,642,889 B1
DATED : November 4, 2003
INVENTOR(S) : Daniel T. McGrath It is certified that error appears in the above-identified patent and that said Letters Patent is hereby corrected as shown below:

Column 8,
Line 3, "EMs devices" should be -- MEMs devices --.

Signed and Sealed this

Tenth Day of August, 2004

JON W. DUDAS
*Acting Director of the United States Patent and Trademark Office*